US008161868B2

(12) United States Patent
Bolzicco et al.

(10) Patent No.: US 8,161,868 B2
(45) Date of Patent: Apr. 24, 2012

(54) RIGID FILTER FOR CAPSULES SUITABLE FOR EXTRACTING BEVERAGES, PARTICULARLY ESPRESSO COFFEE

(75) Inventors: Claudio Bolzicco, Pordenone (IT); Luca Mastropasqua, Trieste (IT); Frans Van Eeden, Trieste (IT); Bruno Dellapietra, Duino Aurisina (IT)

(73) Assignee: Illycaffe' S.p.A. (IT)

( * ) Notice: Subject to any disclaimer, the term of this patent is extended or adjusted under 35 U.S.C. 154(b) by 646 days.

(21) Appl. No.: 12/104,734

(22) Filed: Apr. 17, 2008

(65) Prior Publication Data

US 2008/0257165 A1 Oct. 23, 2008

(30) Foreign Application Priority Data

Apr. 18, 2007 (EP) ..... 07007867

(51) Int. Cl.
*A47J 31/06* (2006.01)
*B01D 27/08* (2006.01)

(52) U.S. Cl. ..... 99/295; 99/323; 210/484; 426/77; 426/111; 426/112; 426/394

(58) Field of Classification Search ..... 99/295, 99/323; 210/484; 426/111, 112, 394, 77
See application file for complete search history.

(56) References Cited

U.S. PATENT DOCUMENTS 5,012,629 A * 5/1991 Rehman et al. ..... 53/453
7,543,527 B2 6/2009 Schmed

FOREIGN PATENT DOCUMENTS

| | | | |
|---|---|---|---|
| EP | 0309708 | | 4/1989 |
| EP | 0468079 | | 1/1992 |
| EP | 1710173 | | 10/2006 |
| EP | 1792849 | * | 6/2007 |
| RU | 2243934 C2 | | 1/2005 |
| WO | 2005092162 | | 10/2005 |

OTHER PUBLICATIONS

European Search Report EP07007867 Dated Jun. 8, 2007.
Russian Office Action Application No. 2008115186/12(016978); Dated Apr. 17, 2008.

* cited by examiner

*Primary Examiner* — Shawntina Fuqua
(74) *Attorney, Agent, or Firm* — Cantor Colburn LLP

(57) ABSTRACT

A rigid filter for capsules suitable for extracting beverages, comprising a flat body having a plurality of through filtering holes, which are sized so as to block the passage of solid particles and allow passage of brewed water or beverage, wherein the holes have a substantially symmetrical shape with respect to the middle plane of the flat body, so that the filter can be inserted into a capsule without taking care of the orientation of such holes with respect to the powdered substance within the capsule.

10 Claims, 3 Drawing Sheets

RIGID FILTER FOR CAPSULES SUITABLE FOR EXTRACTING BEVERAGES, PARTICULARLY ESPRESSO COFFEE

The present invention relates to a rigid filter for capsules which are suitable for extracting beverages, particularly espresso coffee.

BACKGROUND OF THE INVENTION

In the last few years, use of disposable capsules or cartridges containing an edible powdered substance from which a beverage can be extracted by using hot pressurized water has considerably increased.

In particular, capsules containing a dose of roasted ground coffee for brewing the so-called Italian "espresso" coffee have become quite popular, because the beverage obtained by such capsules is very close in terms of taste and appearance to the espresso obtained by using conventional espresso-type coffee machines normally used in bars and restaurants.

Among those capsules, WO 2005/092160 and WO 2005/092162 disclose a particular capsule which contains a substance in powder form, preferably roasted and ground coffee, the capsule being provided with an elastic septum which generates lasting crema and by means of which it is possible to extract a beverage with improved physical and organoleptic characteristics.

The known elastic septum is fixed downstream of the dose of ground coffee and a filter sheet made of paper or tissue is interposed between the dose and the septum. The septum is basically an elastic membrane which has at least one through orifice or slit provided in a central region and which elastically opens when the pressure inside the capsules exceeds a certain threshold.

A drawback observed in known capsules is linked to the complexity in manufacturing the capsule. In particular, some operations which complicate the manufacturing process are linked to the proper installation of the paper or tissue filter within the capsule, which mainly causes gripping and handling problems because of the filter's flexibility.

Another drawback is due to the fact that capsules which contain ground coffee typically use paper filters in order to retain the solid fractions within the capsule and prevent them from being poured into the external cup. The choice of paper filters entails limitations in the design of the capsule, for example forcing the design of the bottom of the capsule to have no regions in which the filter paper might break under the pressure acting inside the capsule or due to surface unevenness or openings.

A filter in polypropylene was proposed in EP-A 0 309 708. However this filter is characterized by frusto-conical openings and by corresponding nipples protruding towards the substance to be extracted. Therefore, this known rigid filter still suffers from manufacturing problems, because the correct orientation with respect to the powdered substance must be observed when the filter is installed within the capsule.

SUMMARY OF THE INVENTION

Aim of the present invention is to overcome the drawbacks of known capsules by providing a filter that allows a considerable reduction in the manufacturing times and costs of said capsule.

Within this aim, an object of the invention is to allow particularly quick and simple installation and fixing of such filter within the capsule.

Another object of the invention is to allow good filtering even in presence of surface ridges in the bottom of the capsule where the filter is laid.

This aim and these and other objects, which will become better apparent hereinafter, are achieved by a rigid filter for capsules suitable for extracting beverages, comprising a substantially flat body having a plurality of through filtering holes, which are sized so as to block the passage of solid particles and allow passage of brewed water or beverage, characterized in that the holes have a substantially symmetrical shape with respect to the middle plane of the flat body, so that the filter can be inserted into a capsule without taking care of the orientation of such holes with respect to the powdered substance within the capsule.

BRIEF DESCRIPTION OF THE DRAWINGS

Further characteristics and advantages of the invention will become better apparent from the description of preferred but not exclusive embodiments thereof, illustrated by way of non-limiting examples in the accompanying drawings, wherein.

In the following description, identical reference numerals designate elements which are identical or have an equivalent technical function.

DESCRIPTION OF THE PREFERRED EMBODIMENTS

Figure 1:
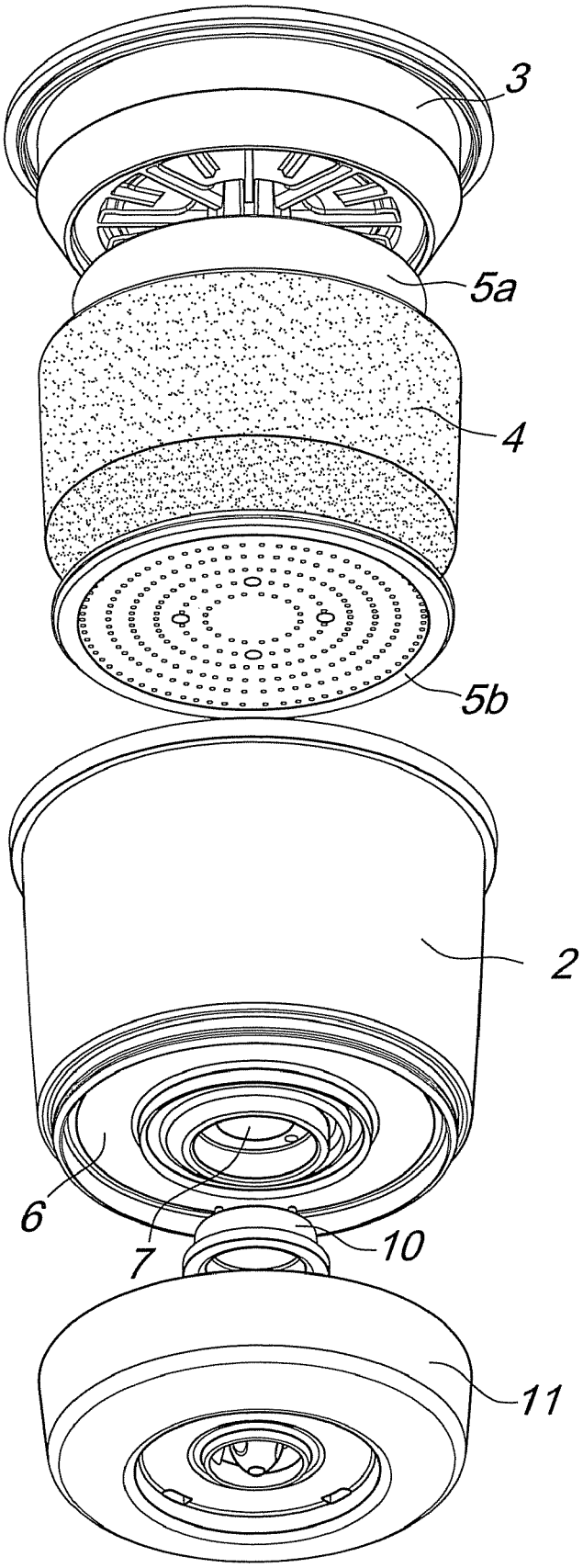
FIG. 1 is an exploded perspective view of a capsule containing the filter according to the invention.
Figure 2:
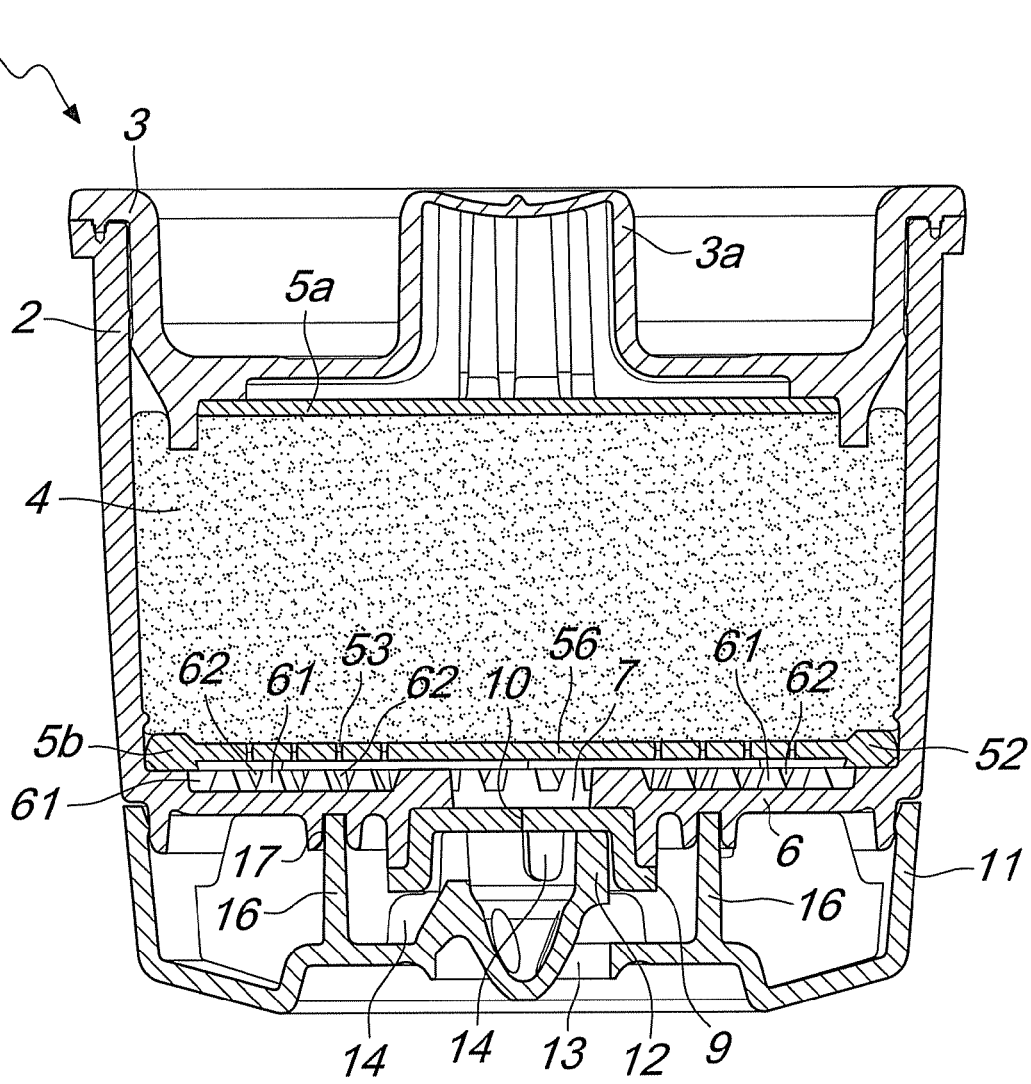
FIG. 2 is a cross-sectional view of the capsule of FIG. 1 in an unexploded condition.
Figure 5:
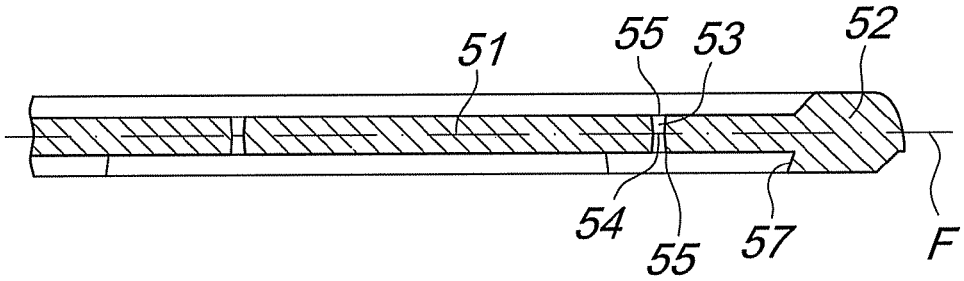
FIG. 5 is a cross-sectional view of the filter of FIG. 4, taken along line V-V.

With reference to FIGS. 1 and 2, a capsule suitable to contain the filter according to the invention, generally designated by the reference numeral 1, is substantially cylindrical (but it can also be frustum-shaped or prism-like) and comprises a box-like body which is formed preferably by two portions, i.e. a cup-shaped portion 2 and an element 3 for closing the cup-shaped portion 2 in an upward region. The closure element 3 is provided with an input port 3*a*, which preferably but not necessarily protrudes and is closed and can be opened in a known manner by the beverage extraction machine by piercing in order to allow the inflow of hot water under pressure into the capsule. The cup 2 and the closure element 3 are welded together preferably by means of ultrasound or known similar techniques, as disclosed for instance in prior art documents WO 2005/092160 and WO 2005/092162, which are herein incorporated by reference.

The box-like body 2, 3 contains a substance in powder form 4, preferably ground coffee, which is suitable to allow the extraction of a beverage, for example espresso coffee, by means of hot water under pressure. The substance in powder form 4 can be comprised between two filtering elements 5*a* and 5*b*, which are adapted to retain the solid fractions, for example the granular coffee residues, within the capsule 1.

At least one of such filtering elements, preferably the lower filtering element 5*b*, is provided according to the invention and is preferably made of molded plastics, such as polypropylene. The filter may also be made of metal or any other material which makes the filter substantially rigid. With the term "rigid" it is meant a substantially planar body which does not significantly buckle under typical pressures inside capsules for extracting beverages, e.g. under pressures of up to 10 bars.

The box-like body of the capsule has a base 6 provided with an output port 7 for the outflow of the extracted beverage. The base comprises preferably a plurality of ridges 61, which are adapted to define narrow channels 62 between the base and the lower filter 5*b* in order to convey the extracted beverage toward the output port 7. The channel are quite thin, preferably about 1 mm wide or less.

The filter 5*b* can be simply laid onto the base 6 or can be attached at its peripheral region. Preferably, the ridges 61 support the filter 5*b*, so as to prevent the filter from buckling during the beverage extraction phase.

The ridges 61 may be arc-shaped and concentrically displaced around the output port 7, so that the channels 62 are directed concentrically to one another and mutually radially connected, as in WO 2005/092160 and WO 2005/092162.

The output port 7, arranged preferably in a central region of the base 6 and surrounded by a rim 8, is substantially closed by an elastic crema forming septum 9 which can open under pressure.

The septum 9 comprises an elastic membrane made of elastomeric or rubber-like material, preferably a thermoplastic elastomer (TPE) such as SEBS (a styrene-ethylene-butylene-styrene block copolymer) or Laprene® (based on SEBS and polyolefins).

The elastic membrane can comprise a through orifice 10, which is adapted to keep closed the septum 9 and therefore the beverage output port 7 when the capsule 1 is not used and is adapted to allow the beverage to pass when the pressure inside the capsule exceeds a certain value, for example 6 bars, causing a deformation and therefore a widening of the orifice 10.

As an alternative to the through orifice 10, the elastic membrane can comprise a blind orifice (not shown in the figures), which can be opened by breaking when the pressure in the capsule reaches a certain threshold.

The elastic septum 9 can be co-molded together with the box-like body 2, 3 of the capsule 1, which is preferably made of polypropylene, so as to eliminate intermediate mechanical operations for fixing the septum 9 to the rim 8 of the output port 7.

As an alternative, the elastic membrane can be co-molded together with a rigid supporting ring (not shown in the figures), which is adapted to be interlocked in a protruding cylindrical rim of the output port 7.

The capsule 1 further comprises a safety lid 11, which is mounted on the box-like body at the base 6 so as to increase the axial dimension of the box-like body. More specifically, the lid 11 is fixed to the box-like body of the capsule so as to protrude from the base 6 substantially in the direction of the axis of symmetry of the capsule along the direction of the stream of water.

The lid 11 is preferably fixed mechanically to a peripheral rim 15 of the base 6, for example by snap action, so as to allow its quick fitting to the box-like body of the capsule 1.

The safety lid 11 is provided with a cylindrical shoulder 12 which is engaged on the septum 9 and is adapted to retain the septum 9 against the output port 7 provided in the base 6, so as to prevent the septum from being accidentally expelled from the capsule due to the high pressures reached during beverage extraction.

The shoulder 12 can have at least one passage 14 in order to allow the beverage to exit from the capsule 1 by passing through the safety lid 11. For this purpose, the lid 11 comprises at least one output opening 13.

The lid 11 may be provided with a second closed cylindrical wall 16, which surrounds the shoulder 12 and can be interlocked within a circular seat 17 which is defined on the base 6 around the output port 7. The walls 12 and 16 thus define a cylindrical ring in which the beverage that exits from the orifice 10 of the septum 9 flows before reaching the output opening 13 provided in the safety lid 11.

Reference is now made to the lower filter element 5*b* according to the invention and to be preferably used in the above capsule 1. Obviously, the person skilled in the art will understand that such filter can be used in any capsule containing powdered substances from which a beverage can be extracted by using water under pressure.

The filter 5*b* is adapted to retain the solid particles of the beverage extracted from the powdered substance 4 with the same effectiveness as filter paper. In particular, the filter 5*b* comprises a flat body 51 surrounded by a thicker rim 52 which protrudes to the same extent from both faces of the flat body 51. A plurality of through holes 53 is also provided in the flat body 51, which are sized so as to block the passage of solid particles and allow the passage of brewed water or beverage.

Figure 3:
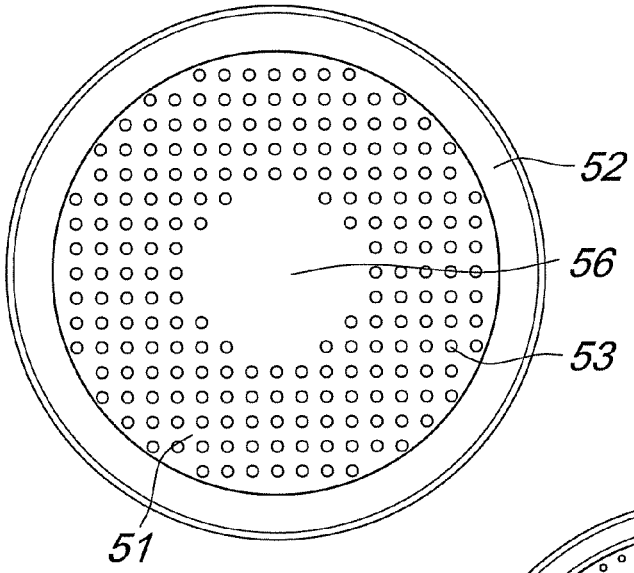
FIG. 3 is a plan view of the filter according to a first embodiment of the invention and used in the capsule of FIGS. 1 and 2.

The holes 53 can be displaced according to any pattern throughout the flat body 51. For instance, the holes 53 can be displaced according to a grid-like pattern as in FIG. 3 or along concentric circumferences as in FIG. 4. Advantageously, if the filter has to be laid onto a plurality of ridges which define channels for conveying the beverage towards the capsule outlet, it is preferred that the holes 53 be superimposed to such channels and not to the ridges, so as to prevent the holes from being clogged by the ridges and, accordingly, to improve both the homogeneity of the beverage fluxes and the filtering efficiency.

Figure 4:
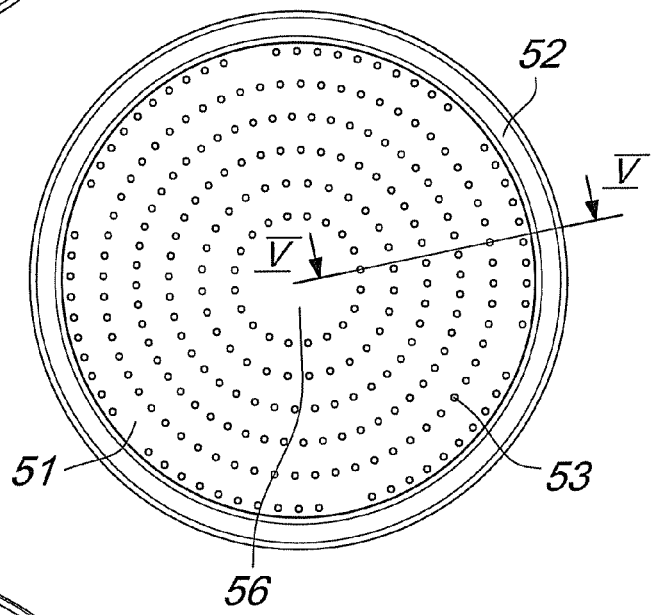
FIG. 4 is a plan view of the filter according to a second embodiment of the invention.

For instance, the holes 53 of filter 5*b* of FIG. 4 are mutually concentrically arranged so as to be aligned with the concentric and radial channels 62 of capsule 1.

The holes 53 have a symmetrical shape with respect to the middle plane F of the flat body 51, so that the filter can be inserted into a capsule without taking care of the orientation of such holes with respect to the powdered substance within the capsule.

In particular, the diameter of each hole 53 in a middle region 54 thereof is narrower than the diameter of the hole 53 in the face regions 55 of the flat body 51, so that the cross-section of each hole 53 symmetrically diverges from the middle region 54 towards the face regions 55. The double-frustum shape of the holes 53 gives the filter a better sturdiness than a cylindrical shape and is also useful during molding of the filter 5*b*, in particular when the mold has to be opened and the filter removed.

The divergence angle from the middle region 54 to any face region 55 is preferably from 1° through 20° or 30°, more preferably about 10°. The diameter of each middle region 54 is preferably from 0.1 mm to 1.0 mm, more preferably from 0.2 mm through 0.4 mm and even more preferably from 0.25 mm through 0.35 mm.

Figure 6:
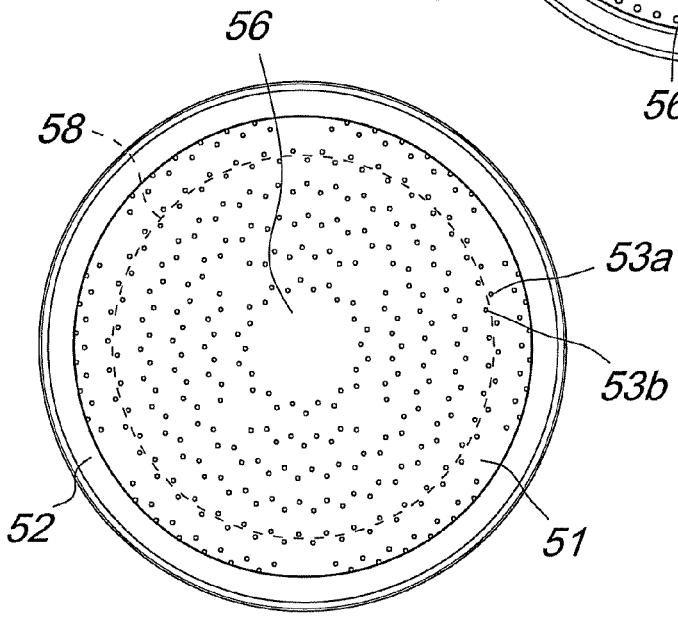
FIG. 6 is a plan view of the filter according to a third embodiment of the invention.

In order to further increase the filtering efficiency, the above holes can be arranged in a staggered configuration 53*a*-53*b*, as in FIG. 6, along patterns 58 (e.g. concentric circular patterns) to be placed above the conveying channels on the bottom of the capsule, such as channels 62. In this way, the density of holes along the patterns, and above the conveying channels, is substantially doubled with respect, for instance, to the filter of FIG. 4.

The flat body 51 of the filter 5*b* can be provided with a substantially circular central region 56 having no holes. Such "full" central region 56 is particularly suitable for capsules containing an elastic septum for generating crema, such as the capsule 1 of FIGS. 1 and 2, because it avoids the high pressurized brewed water to directly hit the septum 9.

Moreover, the absence of holes in the central region 56 improves the filtering action of filter 5*b*. In fact, the filter 5*b* may buckle during the beverage extraction phase because of the presence of an open area below the filter's central region, i.e. the output port 7. If holes were present in the central region 56, such holes would widen, thus worsening the filtering action.

For this reason, the diameter of the full central region 56 of the filter 5*b* is chosen to be substantially equal to the diameter of the outlet port 7. The person skilled in the art can appreciate that the filter 5*b* with a region devoid of any through holes can be used in any capsules for extracting beverages which comprise a quite large open area where the filter could buckle.

The filter 5*b* may also comprise an undercut 57 around the inner periphery of the rim 52, which is useful during molding.

In fact, the filter according to the invention, which is preferably manufactured using two symmetrical molds having respective frustum-shaped pins facing one another so as to define the holes 53, is held at the undercut 56 when it has to be expelled.

It has been found that the invention fully achieves the intended aim, since it allows to considerably simplify the assembling operation of capsules for making beverages. Although the invention has been conceived in particular for capsules suitable for preparing espresso coffee, it can in any case be used more generally for capsules which contain edible substances in general adapted to produce a beverage by percolation or to filter holders to be used in beverage or espresso coffee extraction machines.

The capsule and the filter thus conceived are susceptible of numerous modifications and variations, all of which are within the scope of the appended claims. All the details may further be replaced with other technically equivalent elements.

In practice, the materials used, as well as the dimensions, may be any according to requirements and to the state of the art.

What is claimed is:

1. A rigid filter for capsules suitable for extracting beverages, comprising a substantially flat body having a plurality of through filtering holes, which are sized so as to block passage of solid particles and allow passage of brewed water or beverage, said holes having a substantially symmetrical shape with respect to a middle plane of the flat body, so that the filter can be inserted into a capsule without taking care of an orientation of such holes with respect to a powdered substance within the capsule, said holes having a double-frustum shape, a diameter of each hole in a middle region thereof being narrower than a diameter of the hole at face regions of the flat body, so that a cross-section of each hole symmetrically diverges from the middle region towards the face regions, wherein a divergence angle from the middle region to any one of the face regions of each hole is between 1° and 30° and the diameter of the middle region of the hole is between 0.1 mm and 1.0 mm.

2. The filter of claim 1, wherein the flat body of the filter comprises a substantially circular central region having no holes and wherein the holes are uniformly distributed around such central region.

3. A rigid filter for capsules suitable for extracting beverages, comprising a substantially flat body having a plurality of through filtering holes, which are sized so as to block passage of solid particles and allow passage of brewed water or beverage, said holes having a substantially symmetrical shape with respect to a middle plane of the flat body, so that the filter can be inserted into a capsule without taking care of an orientation of such holes with respect to a powdered substance within the capsule, said holes having a double-frustum shape, a diameter of each hole in a middle region thereof being narrower than a diameter of the hole at face regions of the flat body, so that a cross-section of each hole symmetrically diverges from the middle region towards the face regions, wherein the flat body is surrounded by a thicker rim which protrudes to a same extent from both faces of the flat body, so that the filter is substantially symmetrical with respect to the middle plane of the flat body.

4. The filter of claim 3, wherein said rim comprises an undercut around its inner periphery.

5. A rigid filter for capsules suitable for extracting beverages, comprising a substantially flat body having a plurality of through filtering holes, which are sized so as to block passage of solid particles and allow passage of brewed water or beverage, said holes having a substantially symmetrical shape with respect to a middle plane of the flat body, so that the filter can be inserted into a capsule without taking care of an orientation of such holes with respect to a powdered substance within the capsule, said holes having a double-frustum shape, a diameter of each hole in a middle region thereof being narrower than a diameter of the hole at face regions of the flat body, so that a cross-section of each hole symmetrically diverges from the middle region towards the face regions, wherein the holes are arranged in a staggered configuration along patterns.

6. The filter of claim 1, characterized in that it is made of molded plastics, such as polypropylene.

7. A capsule for extracting a beverage from a substance in powder form, preferably ground coffee, by means of pressurized water, comprising a box-like body which contains said substance in powder form, the box-like body having a base provided with an output port for the outflow of the extracted beverage, and a rigid filter comprising a substantially flat body having a plurality of through filtering holes, which are sized so as to block passage of solid particles and allow passage of brewed water or beverage, said holes having a substantially symmetrical shape with respect to a middle plane of the flat body, so that the filter can be inserted into the capsule without taking care of an orientation of such holes with respect to a powdered substance within the capsule, said holes having a double-frustum shape, a diameter of each hole in a middle region thereof being narrower than a diameter of the hole at face regions of the flat body, so that a cross-section of each hole symmetrically diverges from the middle region towards the face regions, said filter being arranged between said substance in powder form and said output port wherein said base comprises a plurality of ridges protruding towards said filter and defining a plurality of channels for conveying the brewed water or beverage towards said outlet port, said filter comprising a substantially circular central region having no holes and whose diameter is substantially equal to the diameter of the output port, so that no holes are present which directly face the output port, and wherein said output port is substantially closed by an elastic crema forming septum which can open under pressure, said septum facing said central region of the filter that has no holes.

8. The capsule of claim 7, wherein the holes are aligned with and superimposed to the channels and not to the ridges, so as to prevent any hole from being clogged by the ridges.

9. The capsule of claim 7, wherein the filter is supported by said ridges.

10. The capsule of claim 8, wherein the filter is supported by said ridges.

* * * * *